US006308635B1

(12) United States Patent
Abele

(10) Patent No.: US 6,308,635 B1
(45) Date of Patent: Oct. 30, 2001

(54) RAIL HEATING MODULE AND ASSEMBLY

(75) Inventor: Alan C. Abele, Marblehead, OH (US)

(73) Assignee: Kershaw Manufacturing Company, Montgomery, AL (US)

( * ) Notice: Subject to any disclaimer, the term of this patent is extended or adjusted under 35 U.S.C. 154(b) by 0 days.

(21) Appl. No.: 09/405,888

(22) Filed: Sep. 24, 1999

Related U.S. Application Data

(60) Provisional application No. 60/101,575, filed on Sep. 24, 1998.

(51) Int. Cl.[7] ..... E01B 3/04

(52) U.S. Cl. ..... 104/2; 104/7.1; 126/271.2

(58) Field of Search ..... 29/800; 432/175, 432/224, 225, 226; 126/271.2; 110/240; 104/2, 7.1

(56) References Cited

U.S. PATENT DOCUMENTS 3,566,796 * 3/1971 Herrick ..... 104/2
3,722,866 * 3/1973 Herzberg ..... 432/175
4,493,641 * 1/1985 Hubbert ..... 432/120
4,736,818 * 4/1988 Wolfe ..... 184/3.2
4,860,727 * 8/1989 Eads et al. ..... 126/271.2
5,299,504 * 4/1994 Abele ..... 104/2
5,991,506 * 11/1999 Platsch ..... 392/379

* cited by examiner

*Primary Examiner*—S. Joseph Morano
*Assistant Examiner*—Frantz F. Jules
(74) *Attorney, Agent, or Firm*—Christopher A. Holland; Robert J. Veal; Burr & Forman LLP

(57) ABSTRACT

A rail heating assembly including a series of individual heating modules is operable to raise and maintain the temperature of rails of a railroad track to reduce bending and deforming of the rails due to variations of atmosphere conditions. The heating module includes a series of burners with attached radiator plates so as to provide convective and radiant energy to heat the rails. The heating module includes an outer shell and a Venturi-shaped inner shell to surround the rail, with a series of burners attached to one end providing a stratified flame to heat the rail. A series of radiator plates mounted to the inner shell are heated by the flame, and the radiator plates radiate thermal energy towards the rail.

18 Claims, 13 Drawing Sheets

RAIL HEATING MODULE AND ASSEMBLY

This patent application claims benefit of Provisional Patent Application No. 60/101,575, filed on Sep. 24, 1998, for an invention entitled "TRACK AND RAIL THERMAL-ELONGATION SYSTEM."

FIELD OF THE INVENTION

The present invention relates to an apparatus for heating the rails of the railroad tracks for the purpose of installation or repair to reduce undesired thermal expansion or contraction of the railroad tracks. More precisely, the present invention relates to a rail heating module and assembly using convective and radiant heat to transfer thermal energy to a rail of a railroad track to prevent curvature or deformity of the track due to undesirable atmospheric conditions.

BACKGROUND OF THE INVENTION

Multiple methods for laying railroad tracks have been provided in the prior art. One favorable method of laying railroad tracks is laying a continuous welded rail, in which case individual sections of rail are laid on a prepared surface by a rail laying device. Each section of rail is approximately one-quarter mile long, and the rail laying device is operable to dispense and initially align the one-quarter mile long rails. A weld is made to join the two adjoining rails at the junction separating the two adjoining rails. Following the rail laying device is an anchoring device for anchoring the rail to the prepared bed at the appropriate location. Once the rails are anchored, a railway vehicle, such as a train, may then travel on the railroad track. In a similar manner, such a process may be applied to replace rails in existing rail lines that have been worn as a result of railroad traffic.

A common problem occurring during the laying of railroad tracks occurs when the rails deform or bend due to the thermal conditions surrounding the rails. Common deformities include kinks in the rail and pull-aparts in the anchored rail. Such deformities can cause one end of a rail to pull away from the adjacent end of the connecting rail, thereby creating a gap between the rails. A kink in one of the rails typically results in a distortion of the rail and non-parallel arrangement of the rails. The effect of either of these deformities can vary from being an annoyance caused by a rough ride of the railcar to being a hazardous situation caused by the derailing of the railcar vehicle traveling on the railroad tracks.

In response to the problems of distorted tracks, several attempts have been made to control and maintain the elongation of the rails, and thus prevent kinks and pull-aparts. One method of controlling elongation of the rails to be anchored is to preheat the rails to be anchored to a determined temperature and maintain that temperature while each rail is being anchored. Consequently, several methods have been developed to preheat the rails, with none of these methods attaining a manner in which to heat that is efficient and cost effective.

As a result of the experimentation provided regarding heating of railroad tracks, it has been determined that a continuous amount of thermal energy applied to a railroad track will allow the track to remain elongated for either installation or repair. However, the prior art has failed to produce reliable and predictable products for maintaining a temperature throughout the cross-section of the rail and uniformly about a given length. Commonly, the temperatures of rails of railroad track will vary according to the atmospheric conditions, and the previous methods do not maintain the desired temperature for maintaining the length of the rails. One such method includes implementing a conventional propane heater to provide a flame that contacts one spot of the rail. However, such a method does not provide for even distribution of the heat applied, and therefore the rails are remain subject to deformation due to undesirable temperatures.

Another method that has been provided to maintain the elongation of the railroad track is described in U.S. Pat. No. 5,299,504 issued to Abele. In this design, a self-propelled rail heater car is described that includes movable induction heating coils. This design describes the use of induction coils to generate a current in the rails of the railroad tracks so as to heat the rails by induction. While such a process operates to control the thermal properties of the railroad track, it is not cost-efficient for most consumers to purchase and use.

The prior art therefore fails to provide a method for maintaining the railroad tracks at a certain temperature through the entire cross-sectional area of the railroad tracks at an efficient cost for consumers. Therefore, what is needed, and not found in the prior art, is an economical heating module and assembly for heating railroad tracks that provides efficient and even heating of the railroad tracks to prevent curvature or deformity of the track due to undesirable atmospheric conditions.

SUMMARY OF THE INVENTION

An object of the present invention is to provide a rail heating module and assembly that provides efficient heating of the railroad tracks to control and maintain elongation of the railroad tracks.

A further object of the present invention is to provide a rail heating module and assembly that provides heating for the railroad tracks such that the entire length and cross-sectional area of each rail is maintained at a desired temperature.

A further object of the present invention is to reduce the emissions provided in conventional propane rail heating assemblies which limit the attachment to conduit and improve the environmental effects of operating a rail heating assembly.

These and other objects of the invention are met with the present invention for a rail heating module and assembly. The rail heating assembly of the present invention is designed to burn a gas in a combination radiant-convective heating module for effective transfer of thermal energy to continuous welded rail and track for the purpose of elongating the rail to a controlled temperature needed for either rail installation or rail and track repair. The heating modules may be deployed either as "free standing" heating module which may be manually deployed or used on a vehicle such as a truck, or the heating modules may be integrated into a railway vehicle assembly containing its own propulsion device. Therefore, in the latter embodiment, the heating modules may be controlled and automatically traverse the rail to maintain a constant rail temperature profile for a design set temperature as required of the rail while also managing active control of ancillary and adjacent processing vehicles and machinery via telemetry.

In the first embodiment of the rail heater assembly, each heating module includes a series of burners that are attached to a mechanical deployment boom. A series of radiator plates are connected proximate to the burners such that the flames from the burners will heat the radiator plates, and the radiator plates will in turn provide thermal energy to heat the rail. Each radiator plate additionally includes a series of flame apertures, which allow the flames from the burners to traverse the radiator plates and contact the rails to also heat the rail. Accordingly, the rails will be heated with both convective and radiant thermal energy.

In a second embodiment of the rail heater assembly, the heating modules include a series of resistive heating elements that are surrounded by parabolic reflective radiator plates. In this embodiment, an electric current will induce heat in the resistive heating elements which will thereby discharge radiant energy to heat the rails and the parabolic reflective radiator plates. The parabolic reflective radiator plates will accordingly reflect such thermal energy towards the rails.

A third embodiment of the rail heating assembly includes a heating module that includes a series of self-contained air heaters that are attached to a housing operable to surround a rail. In such an embodiment, the self-contained air heaters will generate heated air so as to convectively heat the rails. Additionally, a set of radiator plates may additionally be attached to the housing so that the heated air will further heat the radiator plates such that the radiator plates will additionally produce radiant energy to heat the rails.

In a fourth embodiment, a single convective hot air generator is provided to produce scalding air that is delivered to a distribution manifold surrounding the rails. The distribution manifold includes a series of slits that direct the heated air towards the rails to raise the temperature of the rails. Additionally, a series of radiator plates may also be attached to the inside surface of the distribution manifold such that the radiator plates will be heated to a temperature causing the radiator plates to provide radiant energy towards the rails as well.

In a fifth embodiment of the rail heating assembly, the heating module includes a housing with a pair of burners attached to one end. The housing includes an inner shell and an outer shell, with the inner shell having a Venturi shape. The burners provide a pair of flames at one end of the housing, and the flames are directed inside the inner shell of the housing. The shape of the inner shell therefore causes stratification of the flame, sufficiently heating the rails of the invention. Additionally, a series of radiator plates are mounted to the inner shell to again absorb the thermal energy from the burner, and return radiant energy directed towards the rail. A variation of this embodiment is to include a series of smaller burners surrounding one end of the inner shell of the housing to provide a series of flames in the same manner as described above.

In a sixth and final embodiment of the rail heating assembly, the heating module includes a housing having an inner and outer shell, with a series of burners mounted to the outside surface of the outer shell. Each burner provides a flame directed towards the rail. Additionally, a series of radiator plates are mounted to the inner shell to again absorb the thermal energy from the burner, and return radiant energy directed towards the rail. The radiator plates additionally include flame apertures, which are positioned in the radiator plates to allow the flames to pass through the radiator plates to engage the rails.

BRIEF DESCRIPTION OF THE DRAWINGS

A rail heating module and assembly is depicted in the accompanying drawings which form a portion of this disclosure and wherein.

DESCRIPTION OF THE PREFERRED EMBODIMENTS

Figure 1:
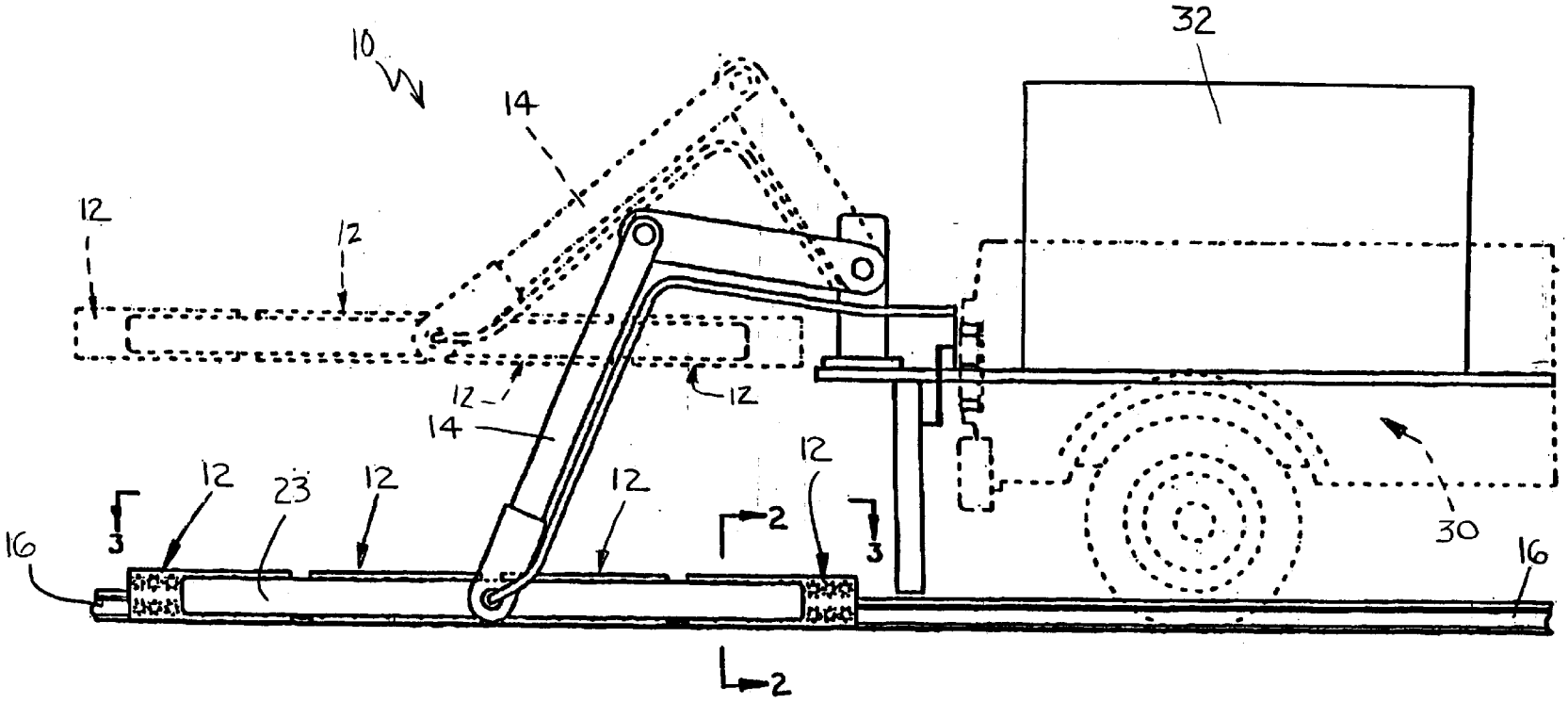
FIG. 1 is a side view of the first embodiment of the rail heating assembly of the present invention attached to a vehicle (shown in phantom), movement of the mechanical deployment boom also shown in phantom.

Referring to FIG. 1, the preferred embodiment of the rail heater assembly 10 of the present invention is illustrated including a series of heating modules 12 attached to a mechanical deployment boom 14. Each of the heating modules 12 serves to transfer thermal energy to a rail 16 for the purpose of mechanically elongating the rail 16 and maintain the rail 16 in its extended position, and thereby keep the rail 16 from either bending or deforming in similar a manner. The heating modules 12 apply heat to the rails 16 both radiantly and convectively so as to heat the entire cross section of the rails 16 surrounded by heating modules 12, which varies from prior gas operated devices that heated only one specific portion of the rail. As a result, the rail heating assembly 10 assures that the rail 16 is maintained in a straight line, which is beneficial during both the installation of the rail 16 and also during repair of a previously laid rail 16, in which case the rail heating assembly 10 may serve as a weld-preheat and post weld treatment of the rails 16.

Figure 4:
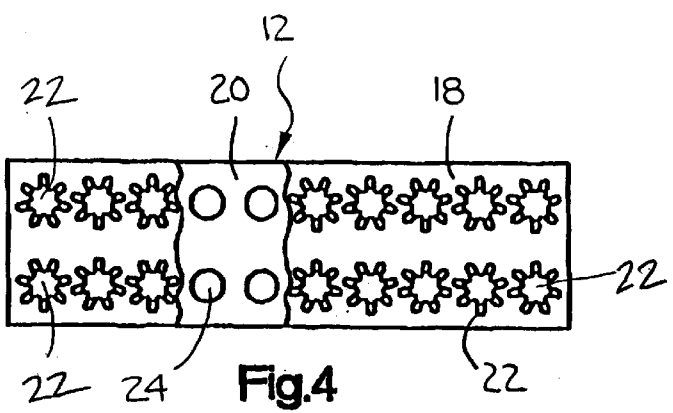
FIG. 4 is a front elevational view of the heating module of the rail heater assembly as illustrated in FIG. 3 taken along the lines 4—4, this view further illustrating a partial view of the radiator plate.
Figure 2:
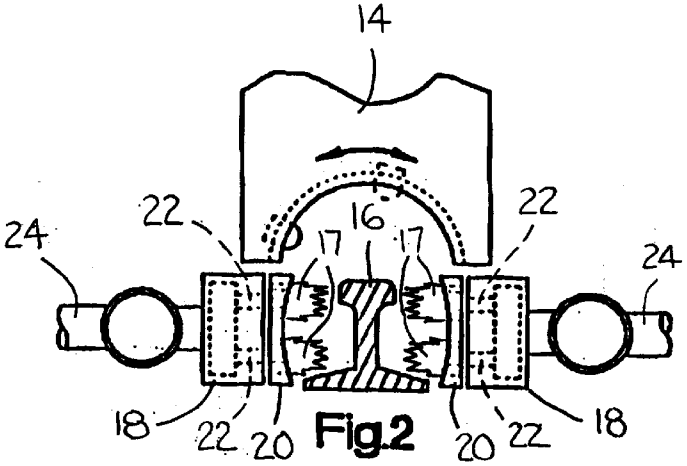
FIG. 2 is a sectional view of the first embodiment of the heating module of the rail heater assembly as illustrated in FIG. 1 taken along the lines 2—2.
Figure 3:
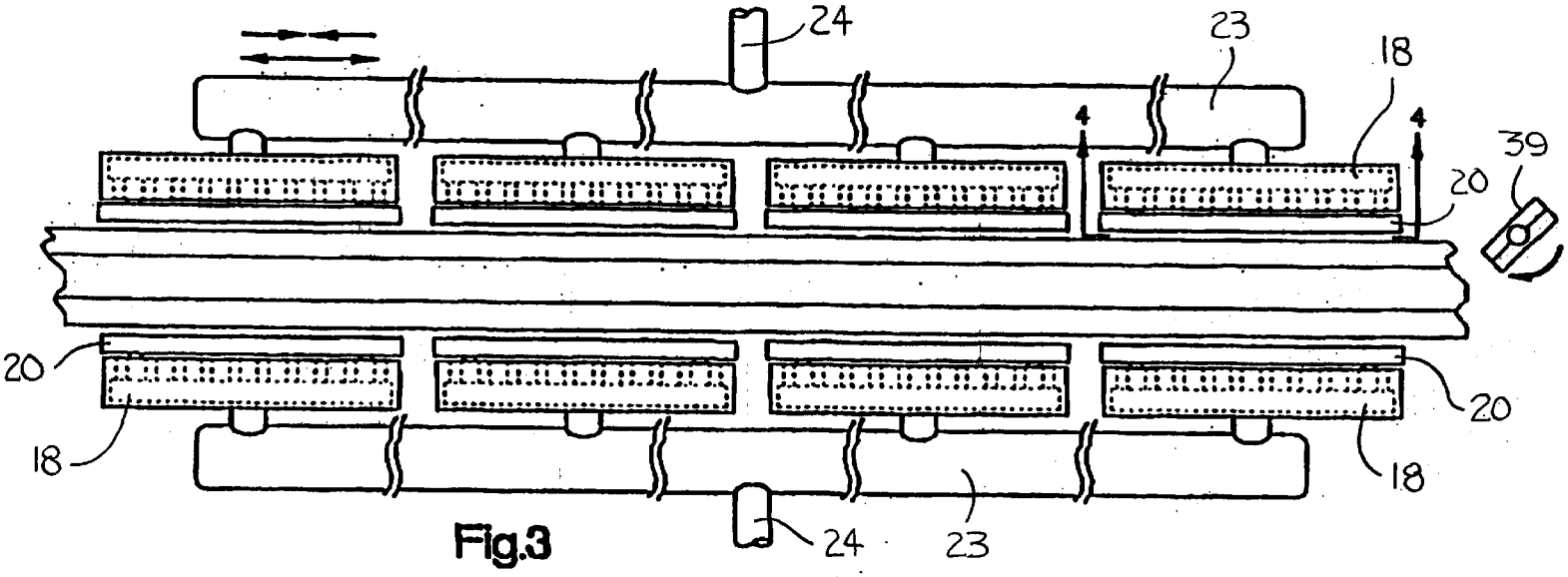
FIG. 3 is a top plan view of the heating module assembly of the rail heater assembly as illustrated in FIG. 1 taken along the lines 3—3.

The preferred embodiment of the heating modules 12 provided in FIG. 1 is shown in greater detail in FIGS. 2, 3, and 4. This embodiment of the heating modules 12 includes a burner 18 connected to a radiator plate 20. The burner 18 in this embodiment includes several ports 22 that provide multiple flames 17 (see FIG. 2). The radiator plate 20 is attached to the burner 18 such that the flames 17 from the burner 18 will engage the radiator plate 20 and heat the radiator plate 20 to the temperature desired. Moreover, the radiator plate 20 also includes a series of flame apertures 24 (see FIG. 4) that allow the flames 17 to traverse the radiator plate 20 to further engage the rail 16. As a result, the flames 17 will heat the rail 16 in both a convective and radiant manner.

Figure 5:
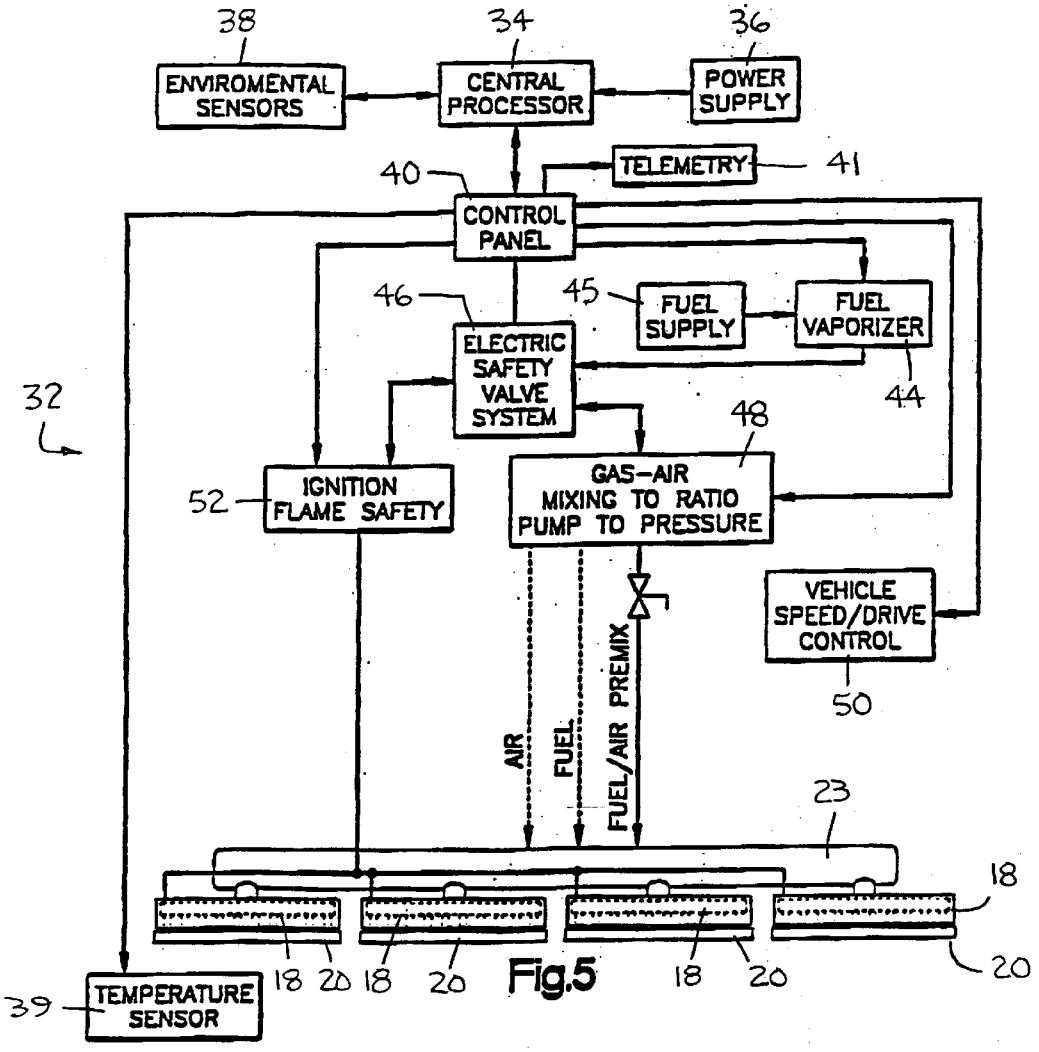
FIG. 5 is a block diagram of the elements and the operation of the elements of the rail heater assembly.

Referring back to FIG. 1, the rail heating assembly 10 is mounted to a vehicle 30 such that each heating module 12 may be positioned to surround a rail 16 by a mechanical deployment boom 14. Each heating module 12 is connected to a gas distribution shaft 23, which in turn is connected, via a conduit 24, to a gas supply 26 (as shown in FIG. 5). In the preferred embodiment, four heating modules 12 are attached to a single gas distribution shaft 23. One gas distribution shaft 23 is therefore able to provide the required gas mixture to each heating module 12 for efficient burning and heating of the rail 16. Furthermore, each burner 18 may be lit by either a manual ignition or a fully automated mechanical ignition.

In the embodiment of the rail heater assembly 10 shown in FIG. 1, the gas distribution shaft 23 is connected via a mechanical deployment boom 14 to a vehicle 30 for transportation. The mechanical deployment boom 14 is maneuverable such that the heating module 12 may be lowered to engage the rail 16 or lifted to safely avoid contact with any objects that may be located along the rails 16.

The gas mixture supplied to each heating module 12 is combined in the control assembly 32 (as represented in FIG. 1 as a block 32) mounted to the vehicle 30, and the independent elements of the control assembly 32 are illustrated in the block diagram of FIG. 5. The control assembly 32 includes a central processor 34 connected to a power supply 36. The central processor 34 is additionally connected to a series of environmental sensors 38 that are used to monitor atmospheric conditions surrounding the rail 16, such as the temperature, wind velocity, wind direction, and the geographic location of the rail heating assembly 10. The environmental sensors 38 therefore provide feedback data to the central processor 34 to determine the heat required to maintain a desired temperature through the rail 16. The central processor 34 can therefore be used to track the time that the heating modules 12 provide heat to the rail 16, as well as predict cool down rates in anticipation of the anchoring of the rail 16.

The central processor 34 is further connected to a control panel 40, which manages the operation of the rail heating assembly 10. The control panel 40 is connected to telemetry 41, which allows for remote operation of the rail heating assembly 10 and remote distribution of the operational parameters. The control panel 40 is also connected to a rail temperature sensor 39, which provides a reading of the temperature of the rail 16 to the control panel 40 to allow for proper adjustments to be made by the central processor 34. The control panel 40 further controls a fuel vaporizer 44, which receives fuel from a fuel supply 45 and provides vaporized fuel to the electric safety valve system 46, and eventually to a gas-air mixer 48. The control panel 40 thereby controls the amount of fuel provided to the gas-air mixer 48. The gas-air mixer 48 thereby provides a mixture of gas and air to the gas distribution shaft 23 as directed by the control panel 40, which is distributed to the burners 18 of each heating module 12. The control assembly 32 additionally includes a vehicle speed/drive control 50 that is used to control the operation of the vehicle 30 to which the rail heater assembly 10 is attached. Furthermore, a conventional ignition flame safety 52 is provided to regulate the flames 17 used to heat the rail 16 and the radiator plates 20.

Figure 6A:
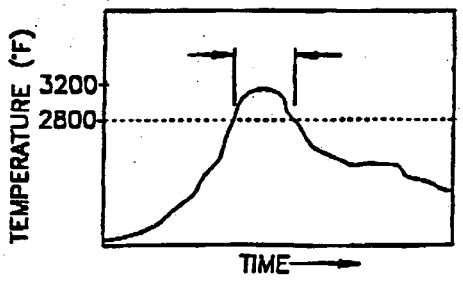
FIG. 6A is a graph illustrating the duration of a flame at a high temperature required to heat the rails using the method of the prior art.
Figure 6B:
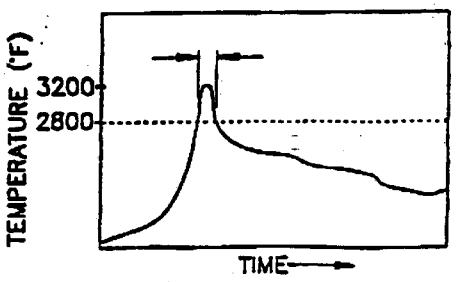
FIG. 6B is a graph illustrating the duration of a flame at a high temperature required to heat the rails using the rail heating assembly of the present invention.

Looking at FIGS. 6A and 6B, the graphs, using equivalent time periods, illustrate how the amount of time that the flame 17 is maintained at a high temperature is reduced using the present invention. Looking at FIG. 6A, the graph illustrates the temperature of the flame 17 with respect to time of a conventional propane rail heater. In contrast, FIG. 6B illustrates the temperature of the flame 17 with respect to time when a convective-radiant heating module 20 is used. Due to flame stratification and the introduction of radiant energy from the radiator plates 20, the time required for the flame 17 to be at its highest temperature (around 2300° Fahrenheit or some critical temperature) is reduced. Since flames 17 produce and emit nitrous oxide when they are burning at their highest temperature, to reduce the amount of time that the flame 17 resides or burns at the temperature will subsequently limit the amount of nitrous oxide emitted by the rail heater assembly 10. Additionally, the inspiration of excess air, stratification of flame temperature, and the air to gas ratio provided to the burner 18 serve to reduce both the production of nitrous oxide and carbon monoxide. As a result, such an embodiment helps to reduce environmental problems such as acid rain.

Figure 7:
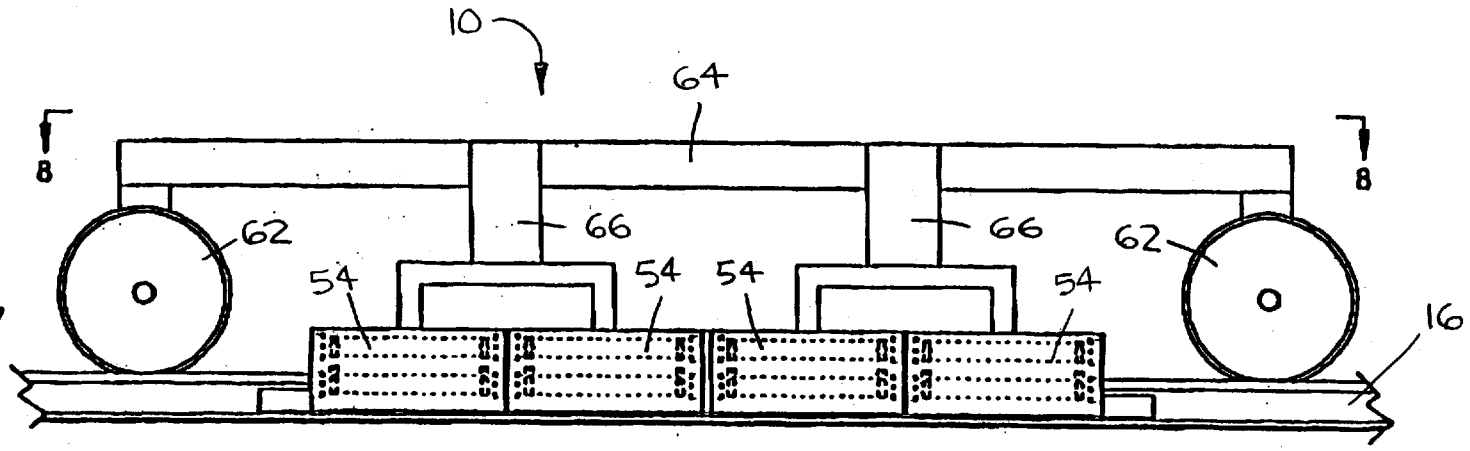
FIG. 7 is a side elevational view of a second embodiment of a rail heating assembly of the present invention.
Figure 8:
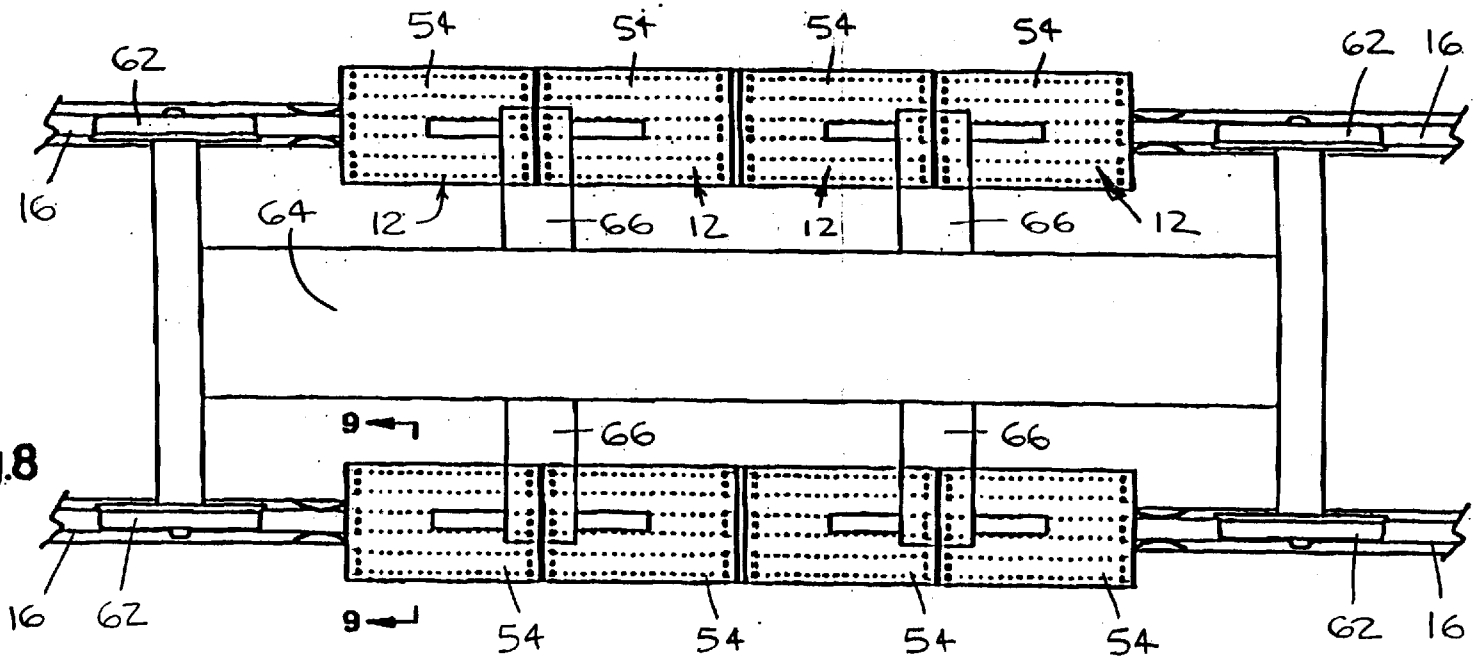
FIG. 8 is a top plan view of the second embodiment of the rail heating assembly of the present invention as illustrated in FIG. 7 taken along the lines 8—8.

A second embodiment of the rail heater assembly 10 is illustrated in FIGS. 7–11. Referring to FIGS. 7 and 8, the heating modules 12 of this embodiment are connected to a railway vehicle 64 between the forward and rearward wheels 62 of the railway vehicle 64. The heating modules 12 are connected to the railway vehicle 64 by a pair of mechanical deployment arms 66 that serve to raise and lower the heating modules 12 so that the heating modules 12 are significantly above the rails 16 when not being used to heat the rails 16.

Figure 9:
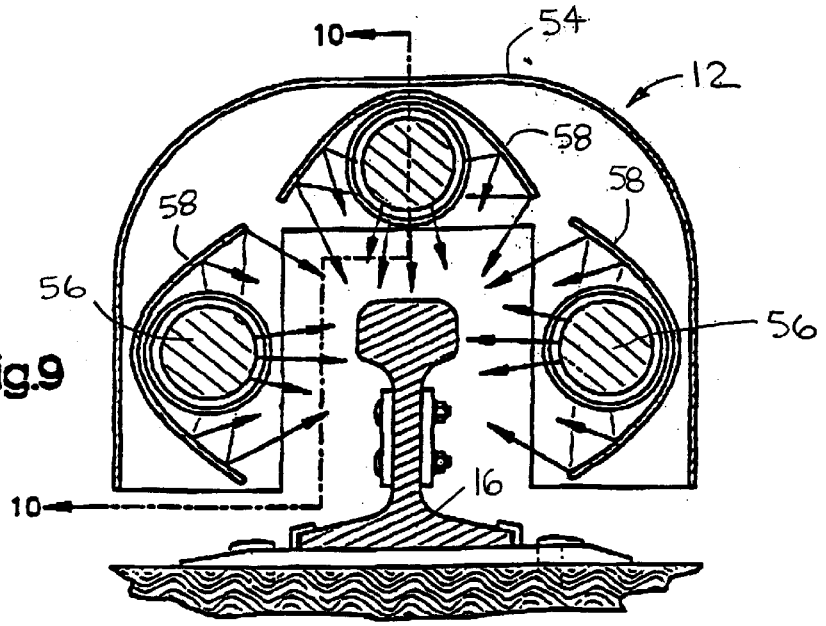
FIG. 9 is a sectional view of the heating module of the second embodiment of the rail heating assembly as illustrated in FIG. 8 taken along the lines 9—9.
Figure 10:
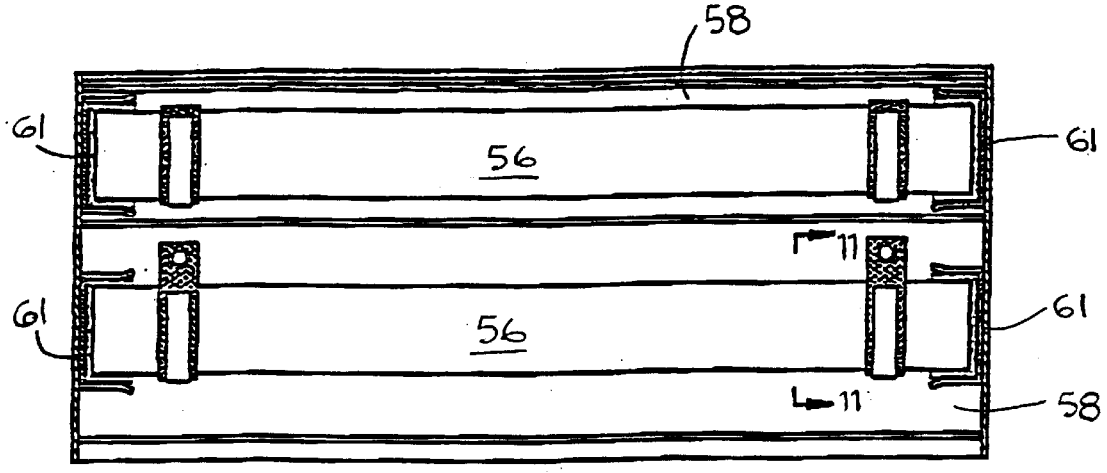
FIG. 10 is a sectional view of the heating module of the second embodiment of the rail heating assembly illustrated in FIG. 9 taken along the lines 10—10.
Figure 11:
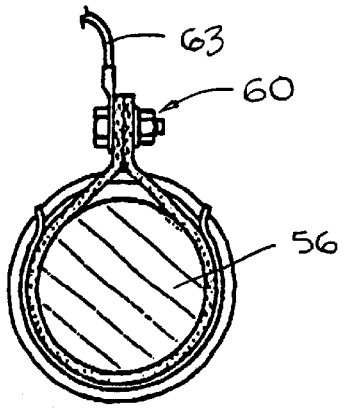
FIG. 11 is a sectional view of the heating element of the heating module illustrated in FIG. 10 taken along the lines 11—11.

Looking further at FIG. 9, each heating module 12 of this embodiment includes a housing 54 that surrounds an electrical heating system preferably made of three electric heating elements 56. Each electric heating element 56 is surrounded by a parabolic reflector 58, and each electric heating element 56 and each adjacent parabolic reflector 58 are substantially the same length as the heating module 12 (see FIG. 10). The electric heating elements 56 are each preferably made of silicon carbide, and are installed a pair of receiving mounts 61 that are connected to a power supply, and further allow for easy connection and disconnection of the electric heating elements 56. When an electric current is transmitted through the electric heating element 56, the electric heating element 56 will become hot and discharge radiant thermal energy, which in turn heats the area of the rail 16 proximate to the electric heating element 56.

The parabolic reflectors 58 receive radiant energy from the electric heating element 56, and reflect the thermal energy to the rails 16 to aid in heating the rail 16. Each electric heating element 56 is connected to the housing 54 using a conventional connecting means 60 (such as a nut and bolt) and the mount 61 attached to the housing 54 (see FIGS. 10 and 11), and has an electrical connection 63 to the vehicle 64 for receiving requisite power.

Figure 13:
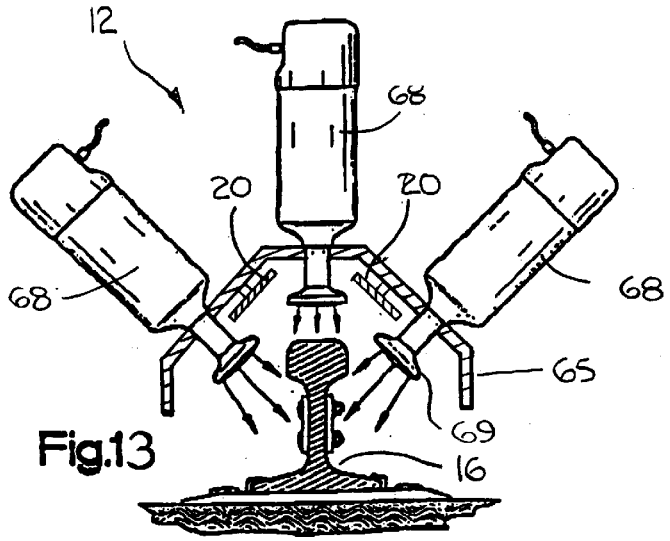
FIG. 13 is sectional view of the third embodiment of the heating module illustrated in FIG. 12 taken along the lines 13—13.
Figure 12:
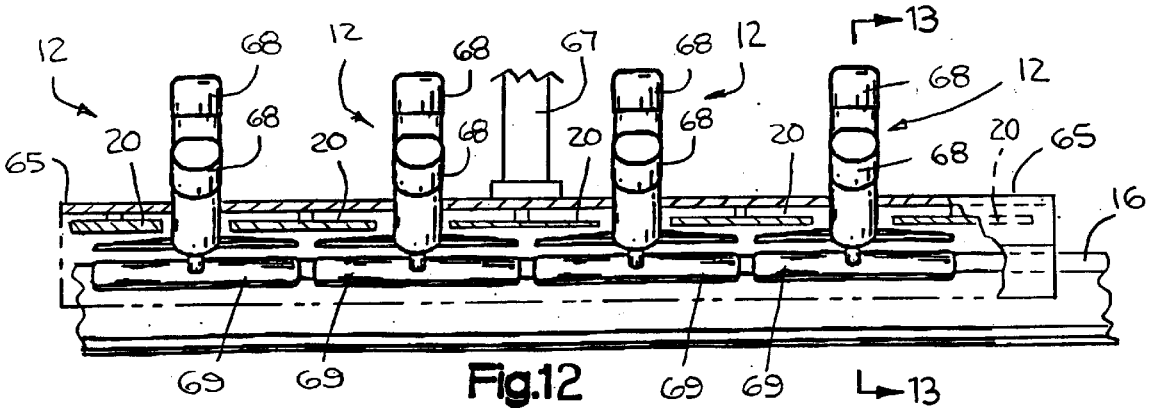
FIG. 12 is a side elevational view of the third embodiment of the rail heating assembly, this embodiment including a plurality of self-contained heaters providing hot air to heat the rail.

In a third embodiment illustrated in FIGS. 12 and 13, convective hot air is generated by self-contained heaters 68 to heat the rails 16. Looking at FIG. 12, the heating modules 12 include a series of self-contained heaters 68 to distribute heated air to the heating modules 12. Insulating walls 65 join the adjacent self-contained heaters 68 to each other, and the insulating walls 65 additionally join each adjacent heating module 12. The insulating walls 65 aid in retaining the heated air so that heating modules 12 will evenly disperse the heated air along the length of the heating module 12 to heat the rail 16. Furthermore, a connecting arm 67 joins the heating modules 12 to a railway vehicle (not shown in FIG. 12) to aid in positioning of the heating modules 12 around the rail 16.

Looking at FIG. 13, each heating module 12 preferably includes three self-contained heaters 68: a top self-contained heater and two side self-contained heaters that are angled towards the rail 16. The self-contained heaters 68 are of a kind conventionally used by those skilled in the art, and are able to generate hot air up to approximately 1700° Fahrenheit. Additionally, each self-contained heater 68 includes an extended exhaust shaft 69 that evenly distributes the heated air to the rail 16 along the length of the extended exhaust shaft 69. A set of radiator plates 20 may additionally be attached to the extended exhaust shaft 69 such that the heated air provided by the extended exhaust shaft 69 will heat the radiator plates 20 to the point that the radiator plates 20 also provide radiant energy to heat the rail 16.

Figure 14A:
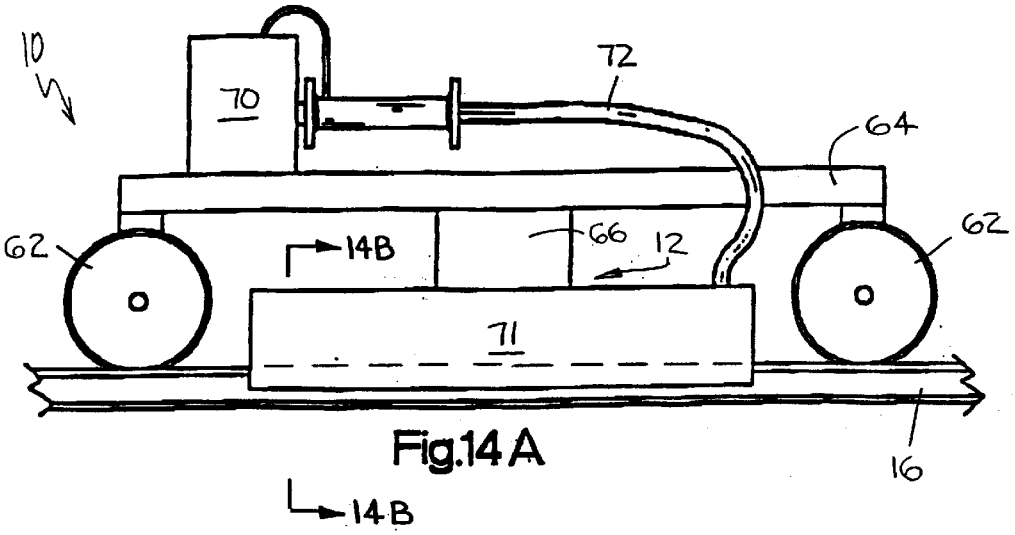
FIG. 14A is a side elevational view of a fourth embodiment of the rail heating assembly, this embodiment of the heating module including a convective hot air generator connected to the heating module to heat the rail.
Figure 14B:
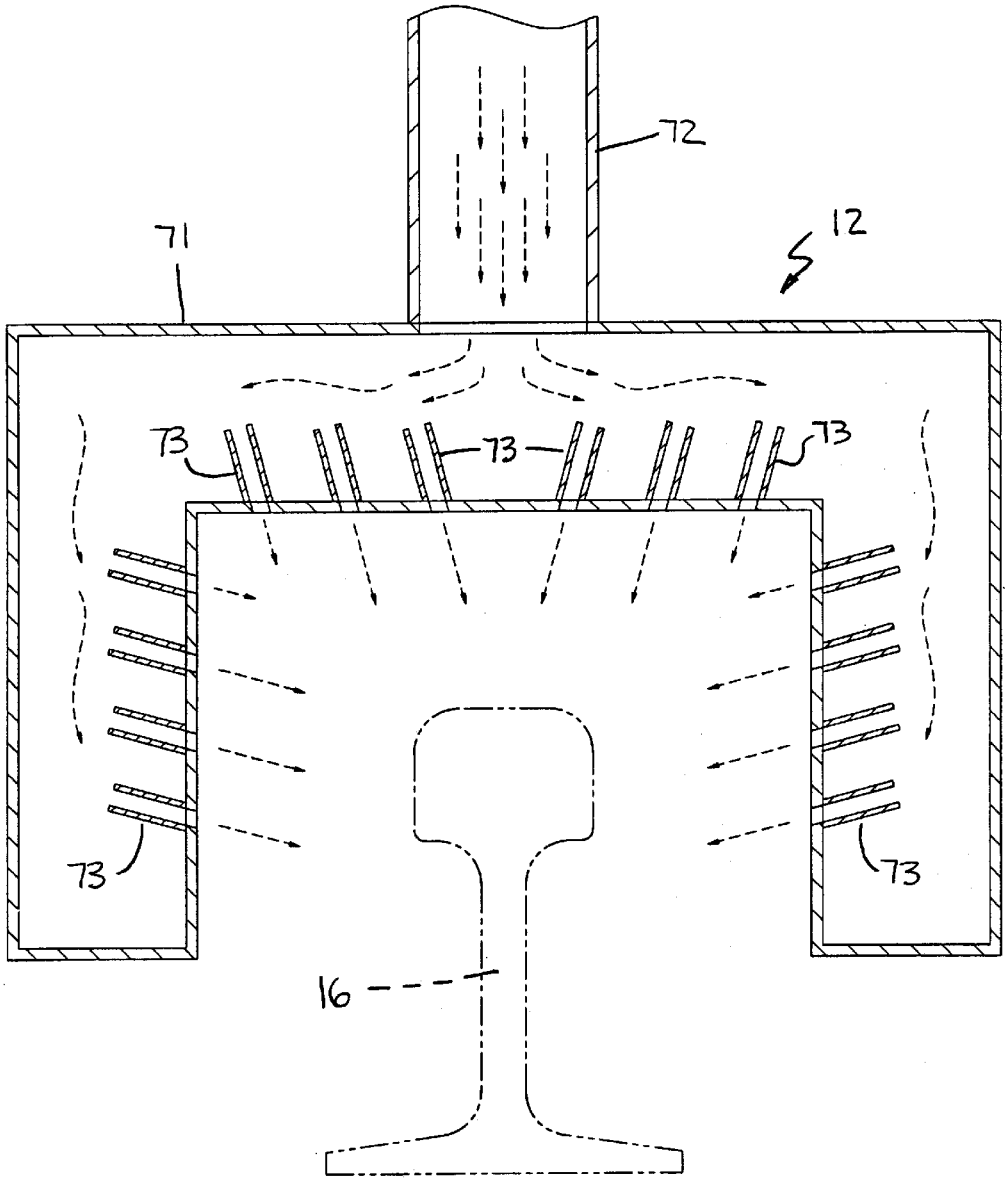
FIG. 14B is a sectional view of the distribution manifold of the rail heating assembly illustrated in FIG. 14A taken along the lines 14B—14B.

A fourth embodiment of the rail heater assembly 10 is shown in FIGS. 14A and 14B, in which the heating module 12 provides hot air to convectively heat the rail 16 similar to the embodiments shown in FIGS. 13 and 14. This embodiment, however, includes a central convective hot air generator 70 attached to the railway vehicle 64 as opposed to a series of independent self-contained heaters. The hot air generator 70, via an insulated duct 72, distributes heated air to a distribution manifold 71 included in the heating module 12 so as to heat the rail 16. The distribution manifold 71 is connected to the railway vehicle 64 via mechanical deployment arm 66. As with the previous embodiment, the hot air generator 70 heats air to a temperature of approximately 1700° Fahrenheit. Looking at FIG. 14B, the distribution manifold 71 includes a series of slits 73, or air knives, that direct the flow of the heated air onto the rail 16. The slits 73 are positioned such that the heated air is directed precisely towards the desired rail 16, thereby reducing the loss of heated air misdirected away from the rail 16.

Figure 15:
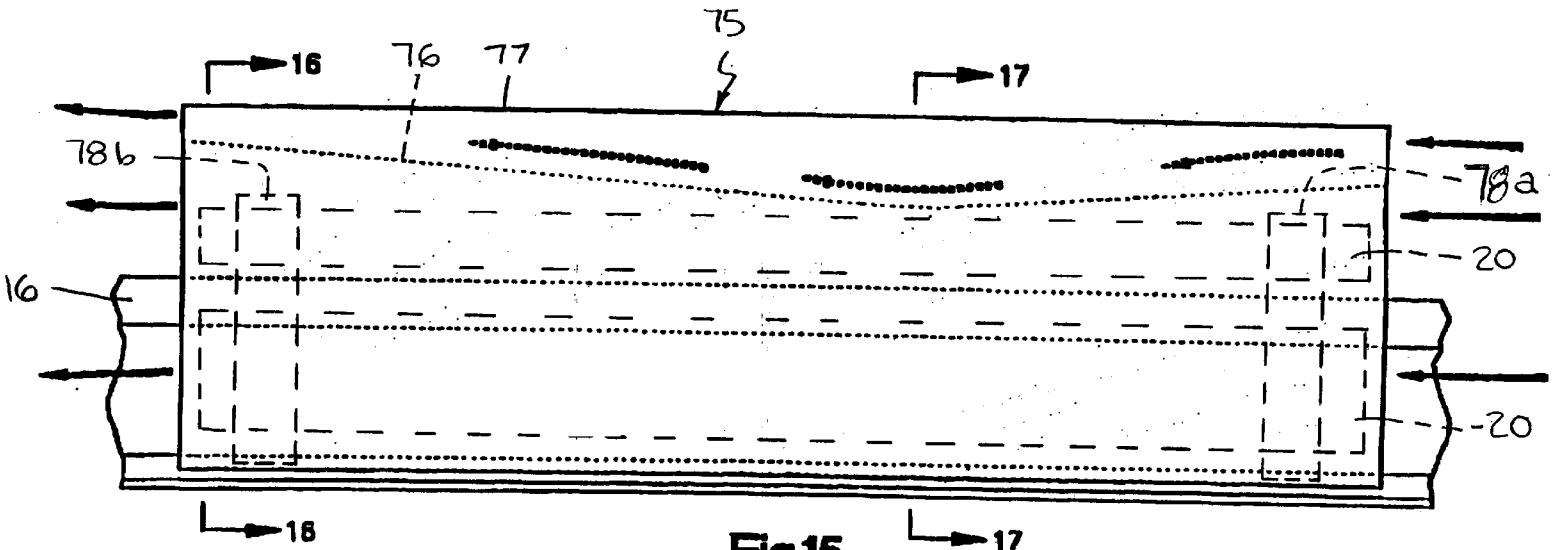
FIG. 15 is a side elevational view of a fifth embodiment of the housing of a heating module of the rail heating assembly of the present invention.

A fifth embodiment of the heating module 12 of the rail heating assembly 10 is illustrated in FIGS. 15–19. The housing 75 of the heating module 12 of this embodiment is illustrated in FIG. 15 as having an inner shell 76, an outer shell 77, and a pair of frame brackets 78*a* and 78*b*. The inner shell 76 of the heating module 12 is Venturi shaped such that approximately the midpoint of the length of the inner shell 76 is constricted. The shape of the inner shell 76 aids in the heating of the rails 16 in that at least one burner (not shown in FIGS. 15–17) is positioned at one end of the heating module 12 to provide the flame and heated air to heat the rails 16. The Venturi shape of the inside surface of the heating module 12 causes a flowing flame and heated air (not shown) to accelerate under pressure to maintain a constant volumetric flow the same as at other locations in the heating module 12.

Figure 17:
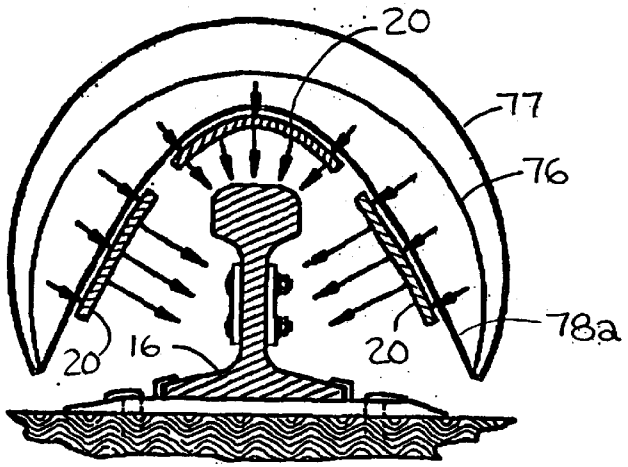
FIG. 17 is a sectional view of the housing of the heating module of FIG. 15 taken along lines 17—17.
Figure 16:
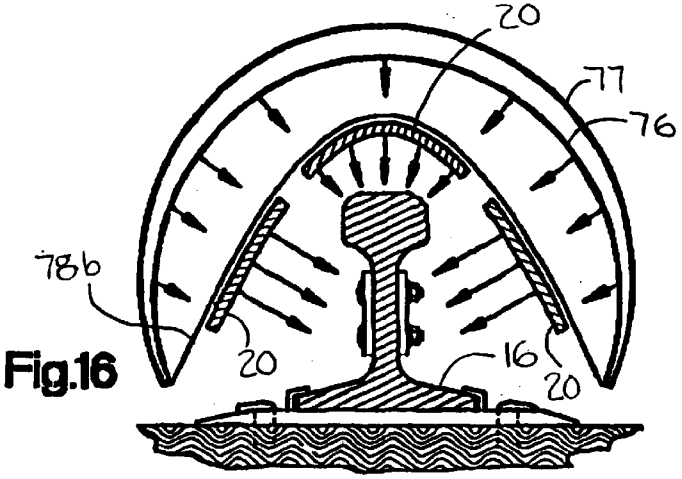
FIG. 16 is a sectional view of the housing of the heating module of FIG. 15 taken along the lines 16—16.

Looking at the cross-sectional views of the housing 75 of this embodiment in FIGS. 16 and 17, the Venturi shaped inside surface is illustrated in that the housing 75 provides a greater area for the passage of the flame in the cross-sectional view of FIG. 16 (taken at one end of the heating module 12 illustrated in FIG. 15) than in the cross-sectional view of FIG. 17 (taken in substantially the mid-point of the heating module 12 illustrated in FIG. 15). As is further illustrated in the cross-sectional views of FIGS. 16 and 17, a series of radiator plates 20 are attached to the frame brackets 78*a*, 78*b* of the housing 75, and the radiator plates 20 are heated by the flame produced by the burners to therefore provide radiant energy to the rail 16 as well.

Figure 18:
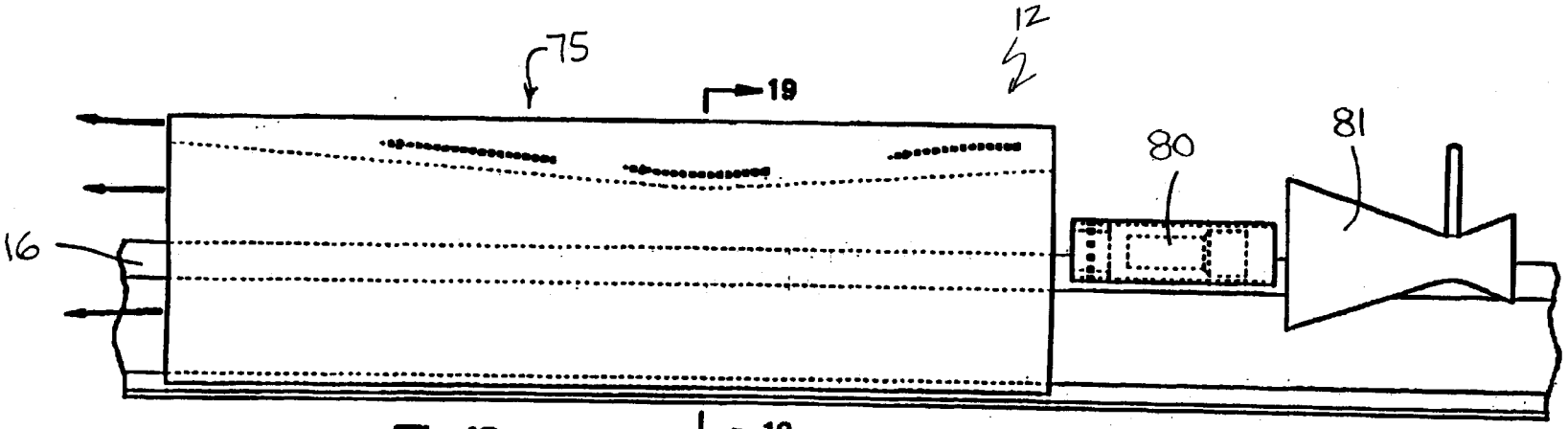
FIG. 18 is a side elevational view of the heating module of the rail heating assembly as shown in FIG. 15 further illustrating the connection of the burners to the housing.
Figure 19:
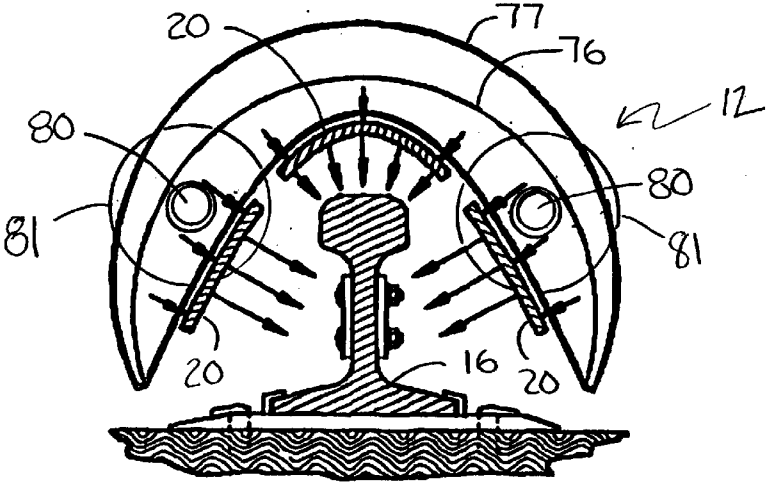
FIG. 19 is a sectional view of the heating module of the rail heating assembly as illustrated in FIG. 18 taken along the lines 19—19.

Referring to FIGS. 18 and 19, a pair of gas burners 80 are illustrated as mounted to one end of the housing 75 to provide a pair of flames (not shown in FIGS. 18 and 19) burning toward the opposite end of the housing 75. Each gas burner 80 receives a gas-air mixture from a pre-mixing unit 81, and provides a flame that traverses the inner shell 76 of the housing 75. The gas burners 80 ignition of the air-gas mixture results in the ignited fuel gasses exiting from the burners 80 and drawing a proportional and controlled amount of combustion air into a turbulent flow creating a flame that surrounds the rail 16 to be heated. Due to the Venturi shaped inside surface of the heating module 12, additional air will be drawn into the flame at the low pressure section of the plenum, thereby creating a stratification of the flame temperature and extending the duration of the combustion process. As a result, emissions from the combustion of the air-gas mixture by the burners 80 will be reduced as well as the development of carbon monoxide.

Looking at FIG. 19, a series of radiator plates 20 are connected to the frame brackets 78*a* and 78*b*. The radiator plates 20 are heated by the flames provided by the burners 80 to the point that the radiator plates 20 transmit radiant energy. As a result, in addition to the heat provided by the flames of the burners 80, the radiator plates 20 will additionally provide radiant energy to heat the rails 16.

Figure 20:
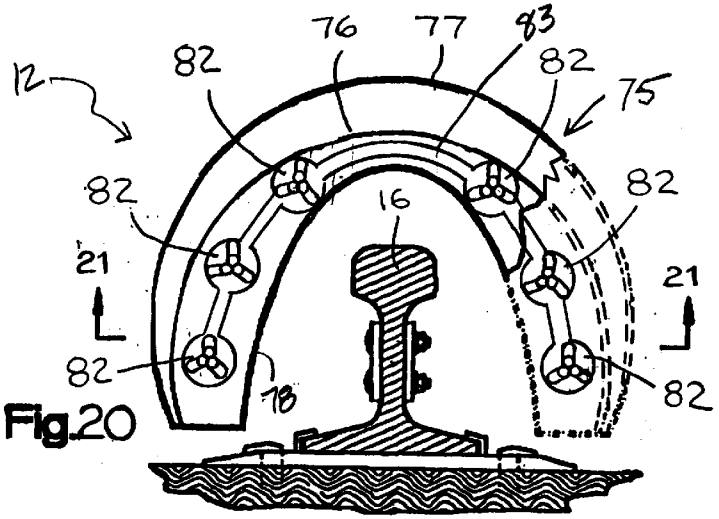
FIG. 20 is a sectional side view of the housing of a sixth embodiment of the heating module of the rail heating assembly, the view exhibiting the burners mounted to the end of the housing.
Figure 21:
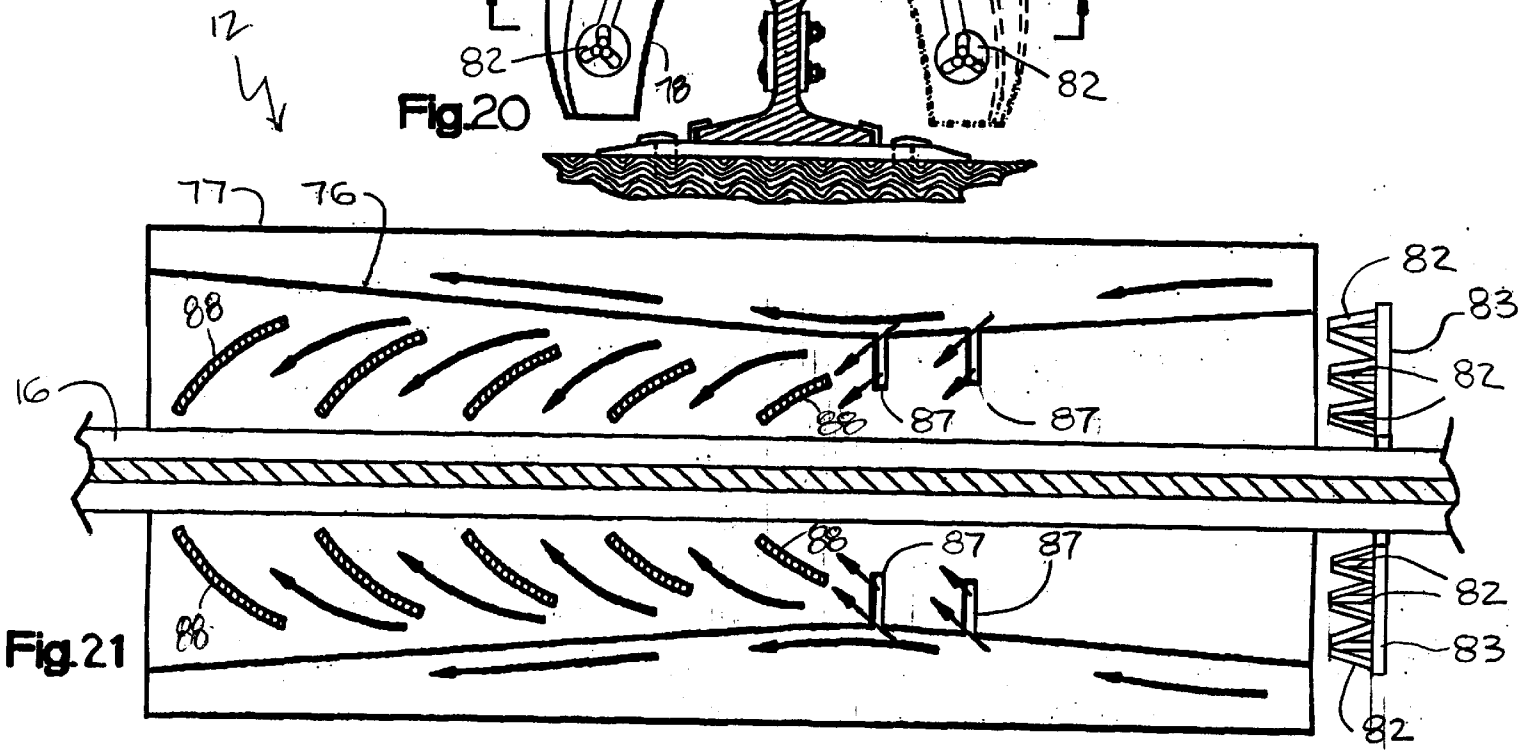
FIG. 21 is a sectional view of the heating module of FIG. 20 taken along the lines 21—21 and further including a series of burners mounted in the burner apertures of the housing.

Referring now to FIGS. 20 and 21, a variation of the fifth embodiment of the rail heating assembly 10 is shown, with the heating module 12 including a housing 75 and a series of small burners 82 connected to one end of the housing 75 instead of the pair of large burners 80 (as shown in FIGS. 18 and 19). The housing 75, as with the previous embodiment, includes an inner shell 76 and an outer shell 77, and may additionally include a frame bracket 78 (as illustrated in FIG. 20). Each burner 82 is attached to the housing 75 such that the flame produced by the burner 82 will traverse the area between the inner shell 76 and the rail 16. Furthermore, each burner 82 is connected to each adjoining burner 82 via a conduit 83 for transmitting the fuel to be burned. Additionally, due to the Venturi shape of the inner shell 76, ambient air will be drawn into the region between the inner shell 76 and the outer shell 77 to aid in insulting the outer shell 77. Also, a series of louvers 87 (see FIG. 21) may be positioned on the inner shell 76 so as to allow the ambient air to flow into the region surrounded by the inner shell 76. This additional air flow further stratifies the flames provided by the burners 82 so as to aid in the heating of the rail 16.

Viewing FIG. 21, a series of arcuate deflector fins 88 may also be attached to the inner shell 76. The arcuate deflector fins 88 aid in heating the rail 16 in several ways. First, the arcuate deflector fins 88 direct the hot convective gasses towards the rail 16 so that the convective gasses will heat the rail 16. Second, the arcuate deflector fins 88 are also heated by the convective gasses, and consequently become efficient radiant heating elements as well. As such radiant elements, the arcuate deflector fins 88 will direct thermal energy toward the rails 16 to further heat the rails 16, and the rails 16 will therefore be heated both convectively and radiantly.

Figures 23, 24:
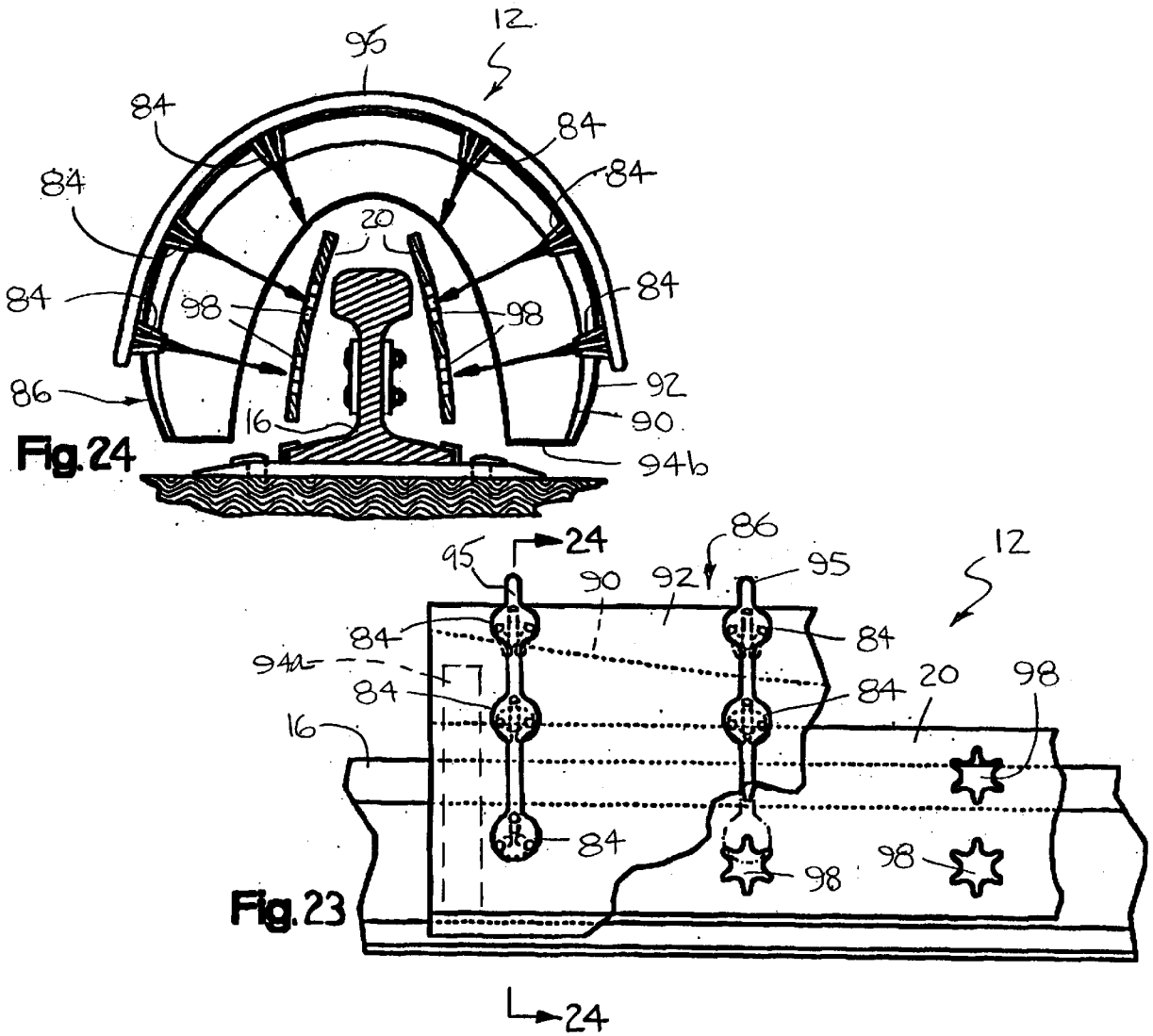
FIG. 23 is a partial side elevational view of the sixth embodiment of the heating module of the rail heating assembly, with the view additionally illustrating the radiator plate attached to the housing.
FIG. 24 is a sectional view of the heating module as illustrated in FIG. 23 taken along the lines 24—24.

A sixth embodiment of the rail heating assembly 10 is depicted in FIGS. 22–25, wherein a series of small burners 84 are mounted along the length of a housing 86 so as to be directed towards the rail 16. Looking at FIG. 22, an outer view of the housing 86 is illustrated with a series of burner apertures 85 included in the housing 86. Referring to FIG. 24, the housing 86 includes an inner shell 90, an outer shell 92, and a pair of frame brackets 94*a*, 94*b* connected to the inner shell 90. Moreover, a series of radiator plates 20 are mounted between the frame brackets 94*a*, 94*b*.

Figure 22:
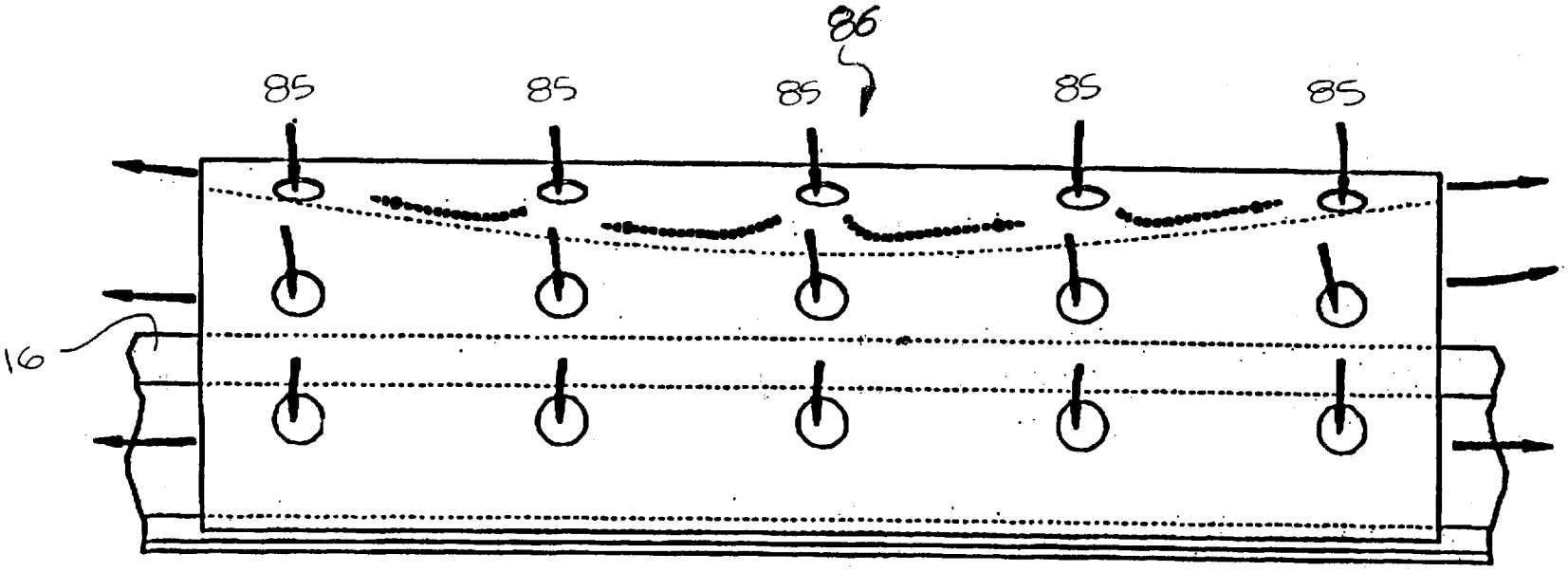
FIG. 22 is a side elevational view of the housing of the heating module of the rail heating assembly of the sixth embodiment.

The outer shell 92 of the housing 86 includes burner apertures 85 to receive the burners 84 (see FIG. 22). The burners 84 are additionally connected to each other via a conduit 95 that distributes the gas to be burned. Referring to FIGS. 23 and 24, the inner shell 90 and the radiator plates 20 additionally include a series of flame apertures 98 that are proportionate in number with the number of burners 84 implemented in this embodiment. The flame apertures 98 are substantially in line with the output of the burners 84, and therefore allow the flames of the burners 84 to substantially pass through inner shell 90 and the radiator plates 20 to engage the rail 16. Additionally, the radiator plates 20 are heated by the flames as the flames traverse the flame apertures 98. Accordingly, the radiator plates 20 will provide an additional amount of radiant energy to heat the rail 16 in addition to the convective energy provided by the burners 84.

Figure 25:
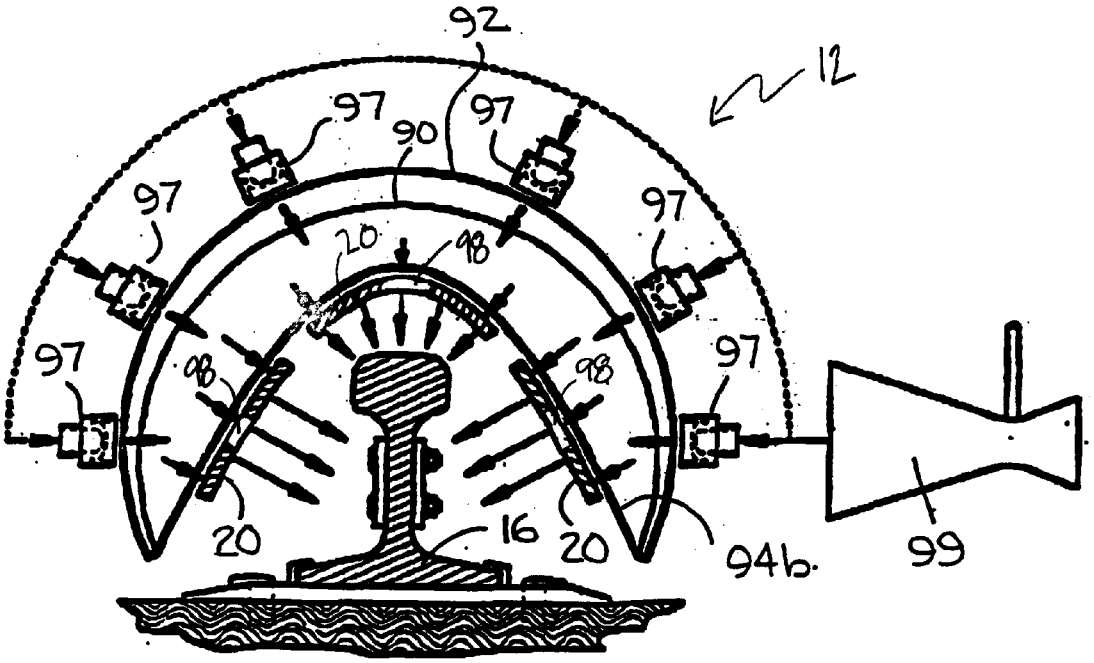
FIG. 25 is a sectional view an embodiment of the heating module similar to that of FIG. 24, with this embodiment including pre-mix burners and three radiator plates.

Comparing FIG. 24 with FIG. 25, the figures illustrate that a varying number of radiator plates 20 may be used in the rail heating assembly 10 mounted to the inner shell 90 at varying positions. FIG. 24 illustrates an embodiment using two radiator plates 20 that substantially surround the sides of the length of the rail 16. FIG. 25 illustrates an embodiment using three radiator plates 20 that substantial surround the top and the sides of the length of the rail 16.

Additionally, FIGS. 24 and 25 illustrate the various burners that may be used with any of the embodiments described above. The burners 84 shown in FIG. 24 are impingement burners, wherein gas jets spew the gas to be burned at the end of the nozzle of the burner 84. However, the burners 97 shown in FIG. 25 are pre-mix burners, and receive a mixed composition of gas and air from a gas-air mixer 99. Both of these burners are conventionally used in the art, and can be implemented with any of the embodiments described above.

Moreover, although not illustrated, each embodiment of the rail heating assembly 10 (with the exception of the fourth embodiment using a central convective hot air generator and a distribution manifold) may be connected to a vehicle 30 via a mechanical deployment boom 14 depicted in FIG. 1. Furthermore, each embodiment may be connected to the vehicle 30 such that the heating module 12 may be laterally moved to heat either rail 16 of a conventional railroad track having two rails 16. Moreover, each embodiment may also be designed to include two independent heating modules 12 attached to the vehicle 30 to provide heat for both rails 16 of the conventional railroad track.

Thus, although there have been described particular embodiments of the present invention of a new and useful RAIL HEATING MODULE AND ASSEMBLY, it is not intended that such references be construed as limitations upon the scope of this invention except as set forth in the following claims.

What is claimed is:

1. A mobile rail heating assembly comprising:

a railway vehicle;

a control assembly mounted on said railway vehicle, said control assembly comprising a central processing unit; and environmental sensing means connected to said central processing unit to monitor atmospheric conditions surrounding the rail, said environmental sensing means comprising first thermometer to measure air temperature, a second thermometer to measure rail temperature, and a barometer to measure atmospheric pressure;

a mechanical deployment arm connected to said control assembly and said railway vehicle; and a heating module connected to said mechanical deployment arm and said control assembly, said heating module including:

a housing; and at least one convective hot air generator connected to said housing; and wherein said central processing unit controls the operation of said heating module according to the atmospheric conditions.

2. The mobile rail heating assembly of claim 1 further comprising:

at least one radiator plate connected to said housing, wherein said radiator plate is heated by said convective hot air generator such that said radiator plate will radiate thermal energy to heat the rail.

3. The mobile rail heating assembly of claim 1 wherein said mechanical deployment arm controls vertical movement of said heating module.

4. The mobile rail heating assembly of claim 1 wherein said control assembly further comprises:

a central processing unit; and environmental sensing means connected to said central processing unit to monitor atmospheric conditions surrounding the rail;

wherein said central processing unit controls the operation of said heating module according to the atmospheric conditions.

5. A mobile rail heating assembly comprising:

a railway vehicle;

a control assembly mounted on said railway vehicle;

a mechanical deployment arm connected to said control assembly and said railway vehicle; and a heating module connected to said mechanical deployment arm and said control assembly, said heating module including:

a C-shaped housing having a first and second end, said housing including an outer shell and an inner shell to substantially surround the rail;

a louver integrated with said inner shell, said louver allowing ambient air to flow into the region surrounded by said inner shell;

at least one burner connected to the first end of said housing to provide a flame within a region surrounded by said inner shell; and a pair of frame brackets connected to said inner shell;

at least one radiator plate attached between said frame brackets;

wherein said flame heats the rail and said radiator plate; and wherein said radiator plate further radiates heat toward the rail.

6. The mobile rail heating assembly of claim 5 wherein said inner shell is Venturi shaped to stratify said flame around the rail.

7. The mobile rail heating assembly of claim 5 wherein said at least one burner is a pre-mix burner.

8. The mobile rail heating assembly of claim 5 wherein said at least one burner is an impingement burner.

9. The mobile rail heating assembly of claim 5 wherein said mechanical deployment arm controls vertical movement of said heating module.

10. The mobile rail heating assembly of claim 5 wherein said control assembly further comprises:

a central processing unit; and environmental sensing means connected to said central processing unit to monitor atmospheric conditions surrounding the rail; and wherein said central processing unit controls the operation of said heating module according to the atmospheric conditions.

11. A mobile rail heating assembly comprising:

a railway vehicle;

a control assembly mounted on said railway vehicle including a central processing unit and environmental sensing means connected to said central processing unit to monitor atmospheric conditions surrounding the rail, said environmental sensing means including a first thermometer to measure air temperature, a second thermometer to measure rail temperature and, a barometer to measure atmospheric pressure; and a mechanical deployment arm connected to said control assembly and said railway vehicle; and a heating module connected to said mechanical deployment arm to heat a rail, said heating module including:

a C-shaped housing having a first and second end, said housing including an outer shell having a plurality of burner apertures and an inner shell having a plurality of flame apertures, and wherein the housing substantially surrounds the rail;

a pair of frame brackets connected to said inner shell;

at least one radiator plate attached between said frame brackets, said at least one radiator plate including a plurality of flame apertures; and a plurality of burners mounted in said burner apertures to provide a flame inside said housing;

wherein said flame contacts and heats said radiator plate such that said radiator plate provides thermal energy to the rail; and wherein said flame traverses said flame apertures of said inner shell and said radiator plate to heat the rail;

wherein said central processing unit controls the operation of said heating module according to the atmospheric conditions.

12. The mobile rail heating assembly of 11 wherein the inner shell is Venturi shaped to stratify said flame around the rail.

13. The mobile rail heating assembly of claim 11 wherein said at least one burner is a pre-mix burner.

14. The mobile rail heating assembly of claim 11 wherein said at least one burner is an impingement burner.

15. The mobile rail heating assembly of claim 11 wherein said mechanical deployment arm controls vertical movement of said heating module.

16. The rail heating assembly of claim 11 wherein said control assembly further comprises:

a central processing unit; and environmental sensing means connected to said central processing unit to monitor atmospheric conditions surrounding the rail; and wherein said central processing unit controls the operation of said heating module according to the atmospheric conditions.

17. A mobile rail heating assembly comprising:

a railway vehicle;

a control assembly mounted on said railway vehicle;

a mechanical deployment arm connected to said control assembly and said railway vehicle; and a heating module connected to said mechanical deployment arm and said control assembly, said heating module including a housing having a first and second end and a heat generator connected to said first end of said housing to generate a heat flow through said housing, wherein said housing further includes an inner shell and an outer shell, said inner shell having a venturi shape to direct said heat flow.

18. The assembly as described in claim 17, wherein said heat generator comprises a gas burner.

* * * * *